US011986135B2

(12) United States Patent
Lopez

(10) Patent No.: US 11,986,135 B2
(45) Date of Patent: May 21, 2024

(54) MODULAR WASHING DEVICE WITH TENSIONING MEMBER

(71) Applicant: Vive Health LLC, Naples, FL (US)

(72) Inventor: Juan Lopez, Naples, FL (US)

(73) Assignee: Vive Health LLC, Naples, FL (US)

( * ) Notice: Subject to any disclaimer, the term of this patent is extended or adjusted under 35 U.S.C. 154(b) by 388 days.

(21) Appl. No.: 17/584,329

(22) Filed: Jan. 25, 2022

(65) Prior Publication Data

US 2023/0233035 A1 Jul. 27, 2023

(51) Int. Cl.

| | |
|---|---|
| ***A47K 7/02*** | (2006.01) |
| ***A46B 5/00*** | (2006.01) |
| ***A46B 9/00*** | (2006.01) |

(52) U.S. Cl.

CPC ..... *A47K 7/028* (2013.01); *A46B 5/0095* (2013.01); *A46B 9/005* (2013.01); *A46B 2200/1006* (2013.01)

(58) Field of Classification Search

CPC . A47K 7/028; A47K 7/08; A47K 7/06; A46B 9/005; A46B 5/0095; A46B 2200/1006

See application file for complete search history.

(56) References Cited

U.S. PATENT DOCUMENTS

| | | | | |
|---|---|---|---|---|
| 2,800,673 | A | 7/1957 | Lazisky | |
| 6,210,057 | B1 | 4/2001 | Yannaci et al. | |
| 8,631,523 | B1 | 1/2014 | Schneider et al. | |
| 8,967,898 | B1 | 3/2015 | Dayeh | |
| 11,000,114 | B2 | 5/2021 | Agha | |
| 11,419,461 | B1 * | 8/2022 | Papageorge | A47K 7/028 |
| 2001/0047564 | A1 * | 12/2001 | Maxwell | B25G 1/04 16/110.1 |
| 2008/0205963 | A1 | 8/2008 | Schmidig | |

* cited by examiner

*Primary Examiner* — Shay Karls

(57) ABSTRACT

The present invention is a washing device with a handle, tensioning member, and loofah. The tensioning member is rotatably attached to the handle by means of a pivot. A plurality of capture features extend from the tensioning member, around which a rope of the loofah is configured to removably attach the loofah to the handle. The tensioning member is rotated away from the handle to expose the capture features, and is rotated towards the handle to create tension is the rope, which secures the loofah to the handle. The loofah further comprises a sponge portion which is configured against a loofah plate at a washing end of the handle. The washing device is used to wash oneself by grasping a handle portion of the handle and using the washing end of the handle with the loofah attached to wash oneself.

19 Claims, 4 Drawing Sheets

MODULAR WASHING DEVICE WITH TENSIONING MEMBER

BACKGROUND OF THE INVENTION

The present invention relates to the field of washing devices. Devices exist in said art that comprise a handle portion and a sponge portion. In many of said devices, the handle portion and sponge portion are permanently attached, which means that the entire device must be discarded when a new sponge portion is needed. Since sponge portions of washing devices inherently become soiled overtime, disposing of said devices is inevitable if the sponge portion is permanently attached to the handle portion.

Some devices in the art exist with sponge portions that are removably attached to the handle portion. However, the methods of attaching these sponge portions are often not secure and lead to the sponge portions being unwantedly detached form the handle portions.

SUMMARY OF THE INVENTION

The present invention is a modular washing device comprising a handle and a loofah. The loofah may be removably connected to the handle by means of a rope and a tensioning member. The tensioning member may be rotatably connected to the handle by means of a pivot.

The loofah of the washing device may exist as a sponge portion connected to the rope. The rope may comprise a first end and a second end that are both connected to the sponge portion of the loofah to create a closed loop. The sponge portion of the loofah may be quasi-circular in shape and may have a diameter. The diameter of the sponge portion, which is also referred to the diameter of the loofah herein, may be the diameter of a circle that best fits the quasi-circular shape of the sponge portion of the loofah. The diameter of the loofah may be at least 3 inches. The diameter of the loofah may further be at least 5 inches. The diameter of the loofah may further be at least 7 inches. Loofahs with smaller diameters are lighter when saturated with liquid and/or soap and fit better into smaller crevices. Loofahs with larger diameters cover a greater area when used for washing.

The sponge portion of the loofah may be any material or configuration of material that when assembled to form the sponge portion, is capable of absorbing liquids. In preferred embodiments of the invention, the loofah is a common string loofah that is well known in the art of washing devices. In such embodiments, the sponge portion of the loofah may be made of the materials used to make common string loofahs, such as but not limited to nylon or natural luffa. In other embodiments, the sponge portion of the loofah may be made of a sponge material, which is a material used to make sponges common to the art of washing devices. Sponge materials include but are not limited to natural sponge, polyester, polyurethane, or vegetal cellulose.

The handle of the washing device may have a length of at least 12 inches. The handle may further have a length of at least 16 inches. The handle may further have a length of at least 20 inches. Handles with shorter lengths are lighter and more easily maneuverable. Handles with longer lengths are more effective at reaching difficult-to-reach areas of one's body when washing, such as the middle of one's back.

The length of the handle may extend from a handle end to a washing end. The handle end may be grasped by a user when the user uses the washing device to wash themselves. A loofah plate may be configured at the washing end of the handle. The loofah plate may be circular or quasi-circular in shape to mimic the basic form of the sponge portion of the loofah. The loofah plate may have a diameter, that may be less than or equal to the diameter of the loofah. The diameter of the loofah plate may be referred to as the "washing end diameter" herein. In some embodiments, the washing end diameter may be greater than the diameter of the loofah. In some embodiments, the washing end diameter may be greater than or equal to 3 inches, but not more than 6 inches. The diameter of the loofah does not affect the length of the handle. That is to say that any diameter of loofah may be used with any length of handle.

A slot may be cut out of the loofah plate. The slot may extend from the edge of the loofah plate to a point near the center of the loofah plate. The slot may be rectangular in shape. The slot may have sharp corners. Alternatively, the slot may have rounded corners. The slot may have a length and a width. The width of the slot may be great enough to accept the closed loop of the rope.

The handle may have a top surface into which a groove may be cut. The groove may have a length and a width. The length of the groove may be parallel to the direction of the length of the handle. The width of the groove may be perpendicular to the direction of the length of the groove. The tensioning member may be rotatably connected to the handle by rotatably connecting the tensioning member to the inside walls of the groove by means of the pivot. The pivot may be located at a pivot end of the tensioning member. The tensioning member may have a length that extends from the pivot end to a locking end of the tensioning member. The length of the tensioning member may be less than or equal to the length of the groove. The tensioning member may also have a width that extends perpendicular to the direction of the length of the tensioning member. The width of the tensioning member may be less than or equal to the width of the groove.

The locking end of the tensioning member may comprise a portion of a lock. The end of the groove that is closest to the locking end of the tensioning member when the tensioning member rests within the groove may comprise another portion of said lock. The lock may be used to secure the tensioning member in place when the tensioning member rests within the groove. The lock may be released so that the tensioning member can rotate freely relative to the handle.

The tensioning member may have at least two opposite faces: a first face and a second face. The first face of the tensioning member may be flush with the top surface of the handle when the tensioning member rests within the groove. The second face of the tensioning member may be the face of the tensioning member that is closest to the bottom of the groove when the tensioning member rests within the groove. A plurality of capture features may extend from the second face of the tensioning member. The closed loop formed by the rope of the loofah may be configured around one of the capture features.

The number of capture features may be at least 3. The number of capture features may further be at least 5. The number of capture features may further be at least 7. A smaller number of capture features increases the manufacturability of the tensioning member, decreases the cost to manufacture the tensioning member, and may increase the strength of each capture feature. A larger number of capture features increases the usability of the washing device by allowing for a greater number of tension options for the rope of the loofah when the rope of the loofah is configured around one of the capture features.

The capture features may be tooth-shaped. "Tooth-shaped" is defined as a quasi-triangular shape that comprises three corners connected by straight lines and/or curves. The corners of tooth-shaped objects may be rounded. The capture features may each have one rounded corner that makes up the end of the capture features that is located furthest from the second face of the tensioning member. The capture features may each have two other corners that are blended into the second face of the tensioning member. A convex curve and a concave curve may extend from the rounded corner of each capture feature towards the second face of the tensioning member. The concave curve of each capture feature may form a surface on which the rope of the loofah may rest when the loofah is removably attached to the handle.

The loofah may be removably attached to the handle by first placing the sponge portion of the loofah against the loofah plate. The closed loop made by the rope of the loofah may then be threaded through the slot of the loofah plate. The closed loop may then be configured around one of the capture features of the tensioning member. Configuring the closed loop around one of the capture features may comprise resting a portion of the rope against the surface formed by the concave curve of one of the capture features.

The capture features may be exposed by rotating the tensioning member away from the handle and therefore out of the groove. Once the closed loop is configured around one of the capture features, the tensioning member may then be rotated towards the handle so that it once again rests in the groove, thus securing the loofah in place. Rotating the tensioning member towards the handle when the closed loop is configured around one of the capture features may create tension in the rope which helps to secure the loofah in place. The tensioning member may further be secured in place by use of the lock at the locking end of the tensioning member and corresponding end of the groove.

Once the loofah is attached to the handle, the washing device may be used to wash oneself. Soap may be added to the sponge portion of the loofah for washing. The soap added to the loofah may be any liquid soap used to wash one's body, such as liquid body wash or liquid shampoo. The soap added to the loofah may further be suds generated from solid soap such as solid bar soap. Solid soap may be rubbed against the sponge portion of the loofah to generate suds, which are deposed on the sponge portion of the loofah and may be used to wash oneself. The handle portion of the handle may be grasped in order to use the washing device to wash oneself. The handle may further be grasped at any located of the handle depending on the user's preference.

DETAILED DESCRIPTION

The description provided herein describes example embodiments of the present invention and is not intended to limit the invention to any particular embodiment, feature, use, size, shape, or any other property. Furthermore, the figures provided herein are for means of example, and are not intended to limit the invention to any particular embodiment, feature, use, size, shape, or any other property. The claimed invention is best understood by the appended claims.

Figure 1:
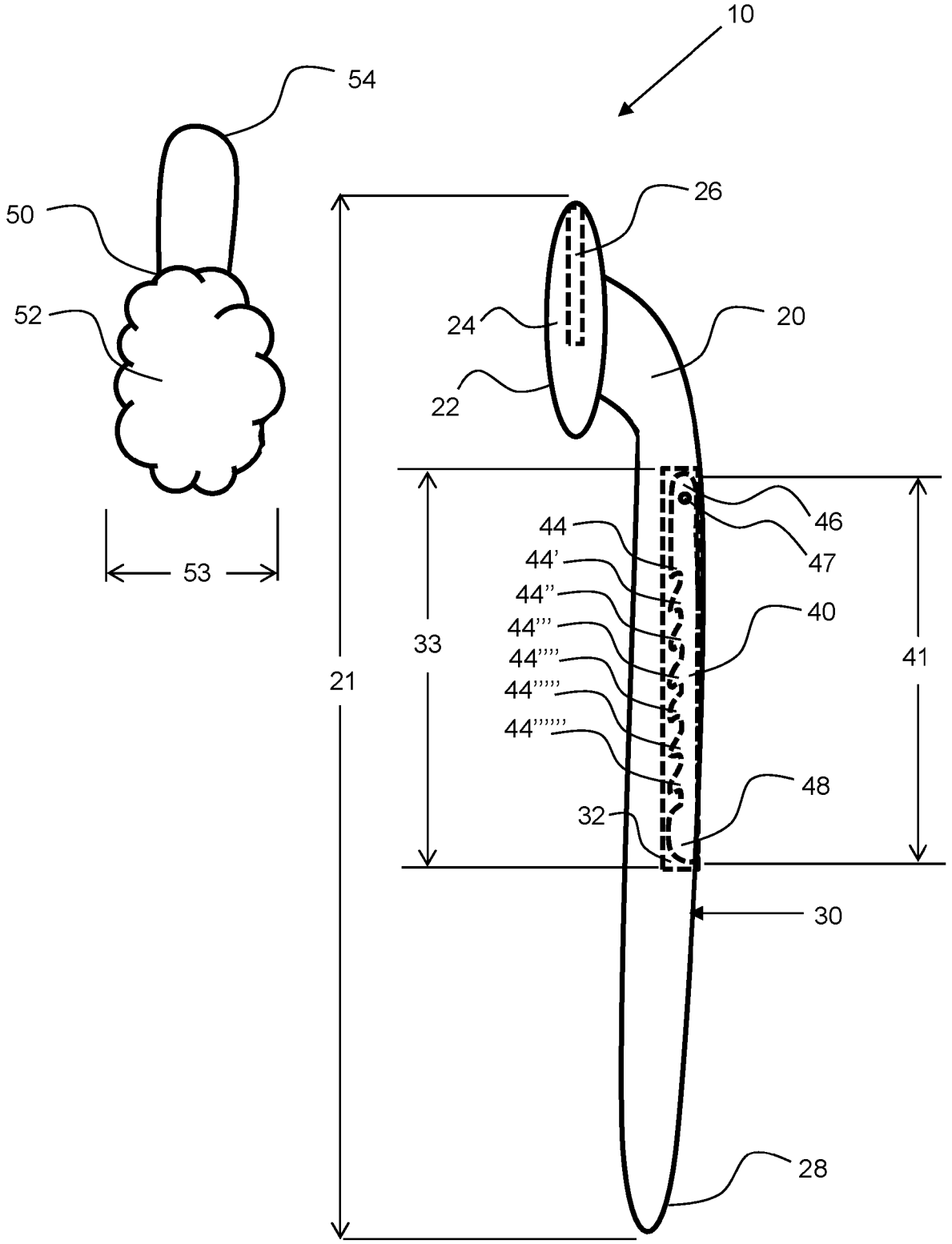
FIG. 1 is a right-side view of a washing device with a loofah detached from a handle.

As shown in FIG. 1, a washing device 10 utilizes a handle 20 and a loofah 50, which are detached from one another in FIG. 1. The handle 20 is an elongated member with a length 21 that extends from a handle end 28 and a washing end 22. A loofah plate 24 is configured at the washing end 22 of the handle 20. A slot 26 is cut into the loofah plate 24. The slot 26 is a rectangular shape and extends from the edge of the loofah plate 24 to a point near the center of the loofah plate 24.

A groove 32 is cut into a top surface 30 of the handle 20. The groove 32 has a length 32. A tensioning member 40 is configured within the groove 32. The tensioning member 40 is an elongated member with a length 41 that extends from a locking end 48 to a pivot end 46. The length 41 of the tensioning member 40 is less than or equal to the length 33 of the groove 32. The pivot end 46 of the tensioning member 40 connects to the walls of the groove 32 by means of a pivot 47, such that the tensioning member 40 is rotatably connected to the groove 32, and therefore rotatably connected to the handle 20. The locking end 48 of the tensioning member 40 may connect to the groove via a lock (not shown). A plurality of capture features 44, 44', 44", 44''', 44'''', 44''''', and 44''''' are configured on a surface of the tensioning member 40 that is opposite to the surface of the tensioning member 40 that is flush with the top surface 30 of the handle 20.

The loofah has a diameter 53 that extends across a sponge portion 52 of the loofah. A rope 54 is connected to the sponge portion 52 of the loofah 50. The rope 54 comprises a first end and a second end, which are both connected to the sponge portion 52 to form a closed loop.

Figure 2:
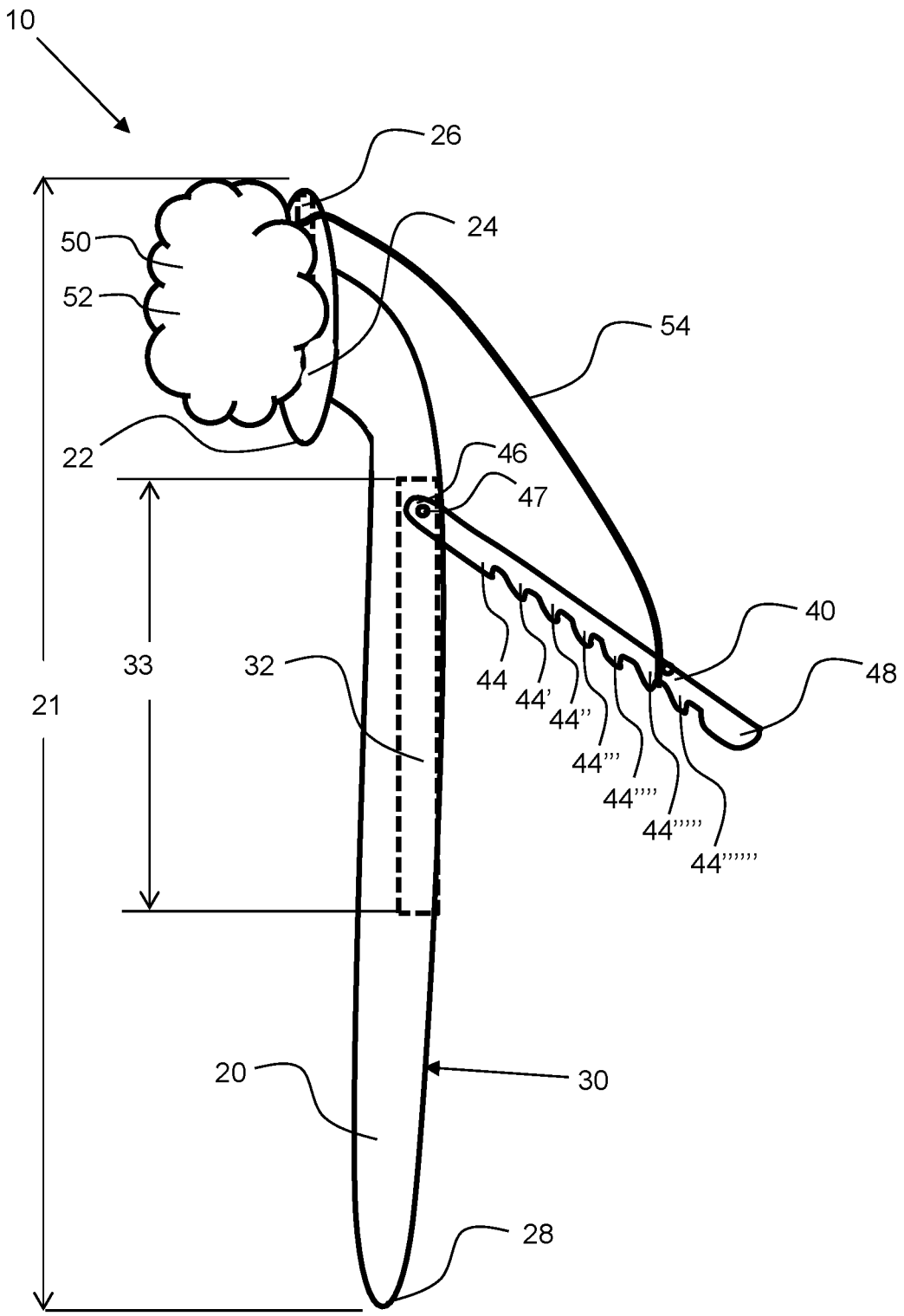
FIG. 2 is a right-side view of a washing device wherein a tensioning member is rotated away from a handle and a loofah is being removably attached to the handle.

As shown in FIG. 2, the closed loop of the rope 54 is configured around one of the capture features 44'''' of the tensioning member 40. The tensioning member 40 is rotated away from the handle 20 by means of the pivot 47 in order to expose the capture features 44, 44', 44", 44''', 44'''', 44''''', and 44''''' from the groove 32. The sponge portion 52 of the loofah 50 is configured against the loofah plate 24. The rope 54 is threaded through the slot 26 of the loofah plate 24 before being configured around the capture feature 44'''''. Because of the view of FIG. 2, only one side of the closed loop is visible.

Figure 3:
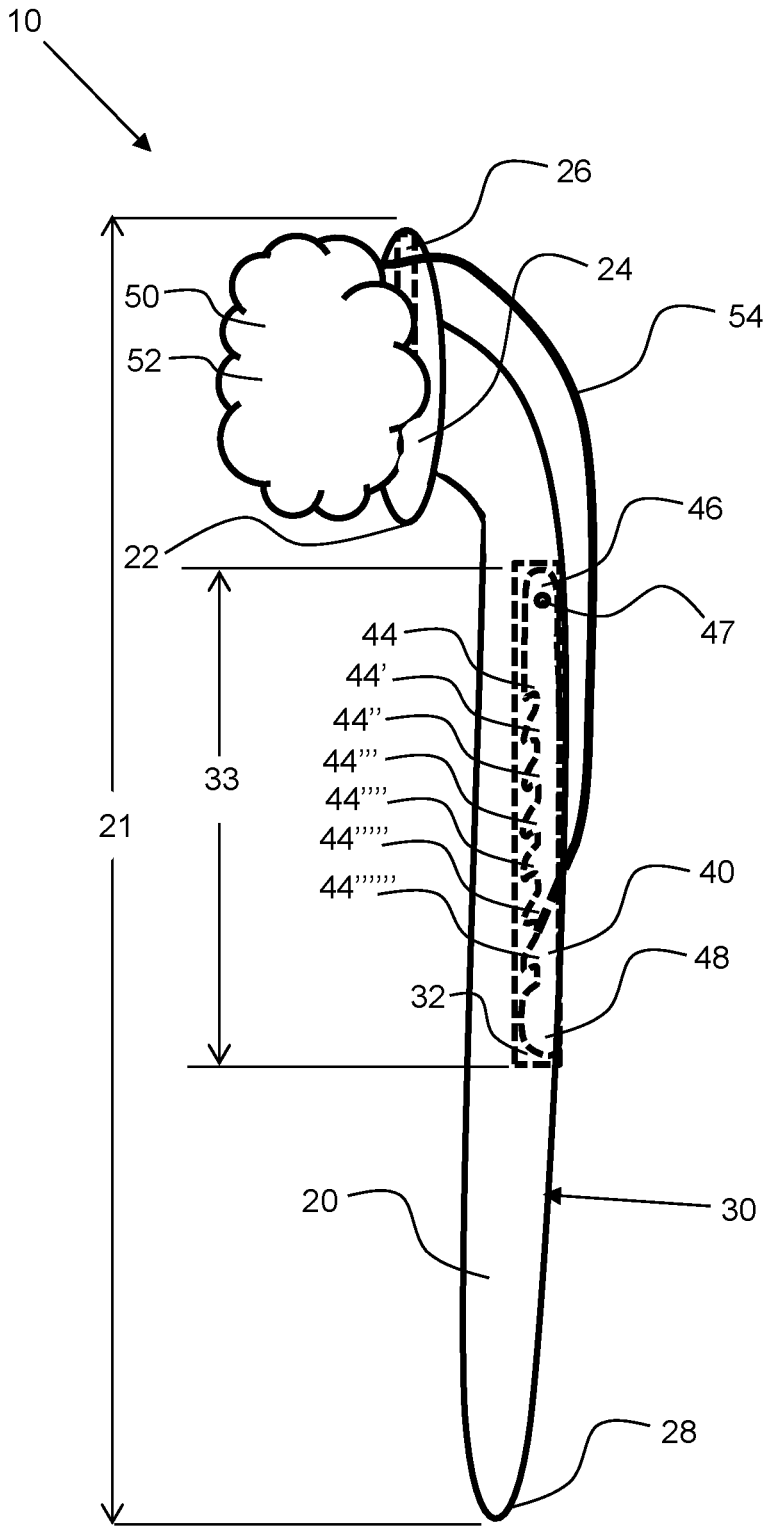
FIG. 3 is a right-side view of a washing device wherein a tensioning member is rotated towards a handle and a loofah is removably attached to the handle.

As shown in FIG. 3, after the closed loop of the rope 54 is configured around the capture feature 44, 44', 44", 44''', 44'''', 44''''', and 44''''', the tensioning member 40 is rotated towards the handle 20 by means of the pivot 47 so that the tensioning member 47 once again rests within the groove 47. The tensioning member 40 may be secured in place by means of the lock at the locking end 48 of the tensioning member 40. The pivoting of the tensioning member 40 towards the handle 20 after the rope 54 has been configured around the capture feature 44, 44', 44", 44''', 44'''', 44''''', and 44''''' creates tension in the rope 54 which secures the loofah 50 in place. The sponge portion 52 of the loofah 50 is now secured against the loofah plate 24 of the handle 20 so that a user may use the washing device 10 to wash themselves.

Figure 4:
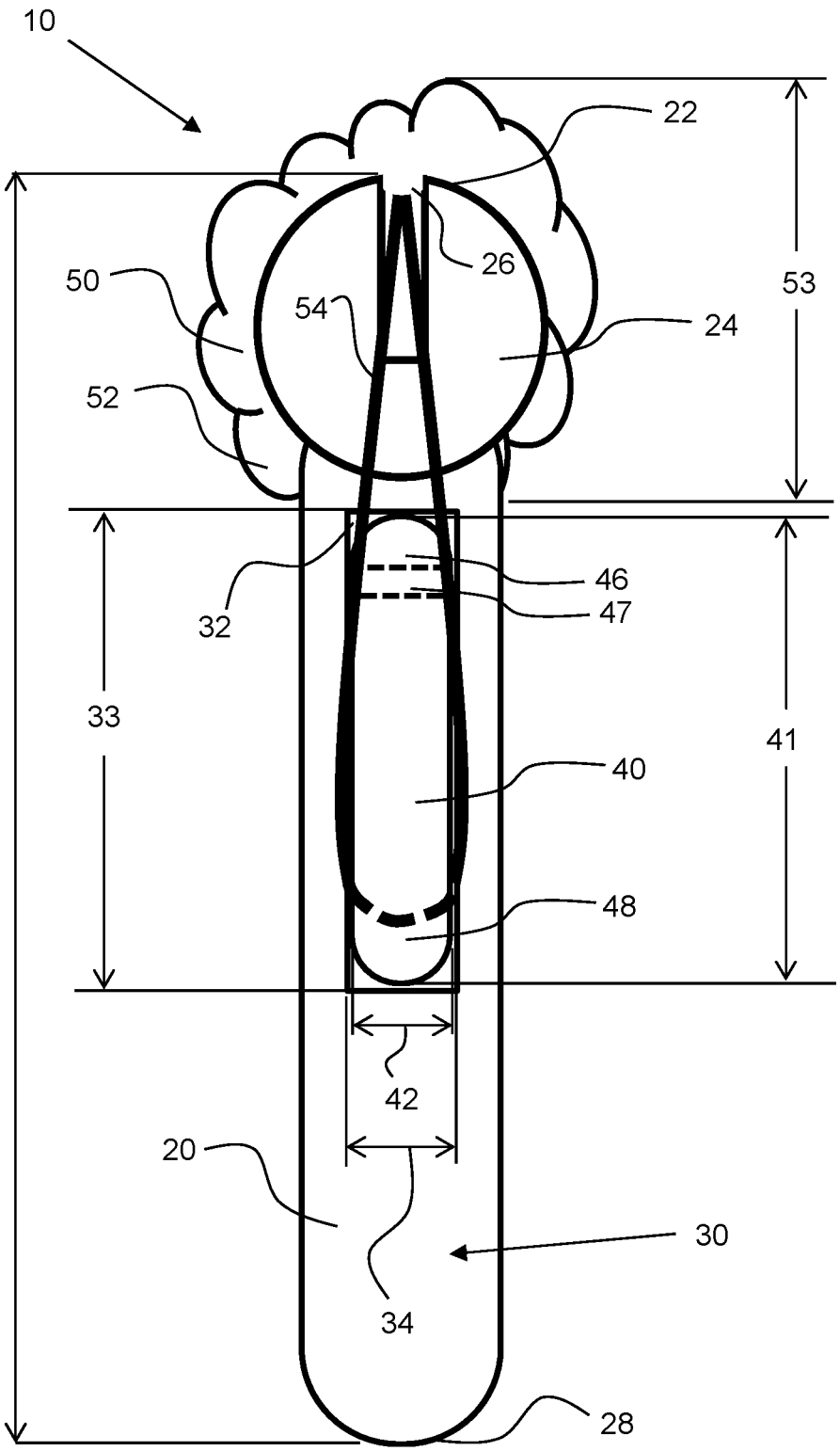
FIG. 4 is a top view of a washing device wherein a tensioning member is rotated towards a handle and a loofah is removably attached to the handle.

As shown in FIG. 4, the groove 32 has a width 34, and the tensioning member 40 has a width 42. The width 42 of the tensioning member 40 is less than or equal to the width 34 of the groove 32. As shown in FIG. 4, the sponge portion 52 of the loofah 50 is configured against the loofah plate 24 of the handle 20. The rope 54 is threaded through the slot 26 of the loofah plate 24 and is configured around the capture feature (not shown in FIG. 4). The tensioning member 40 rests within the groove 32, and is rotatably connected to the groove 32 by means of the pivot 47, which is located at the pivot end 46 of the tensioning member 40.

What is claimed is:

1. A washing device, comprising:
a handle, the handle comprising:
a washing end;
a handle end;
a top surface, the top surface comprising a groove;
a tensioning member, the tensioning member comprising a plurality of capture features;
a loofah, the loofah comprising:
a sponge portion; and
a rope, the rope comprising a first end and a second end;
wherein the first end and the second end of the rope are permanently affixed to the sponge portion of the loofah to create a closed loop,
and wherein the tensioning member of the handle is rotatably attached to the handle,
and wherein when the tensioning member is rotated towards the handle, the tensioning member rests within the groove of the top surface of the handle,
and wherein when the tensioning member is rotated away from the handle, the plurality of capture features is revealed,
and wherein the sponge portion of the loofah is configured against the washing end of the handle,
and wherein when the tensioning member of the handle is rotated away from the handle to reveal the plurality of capture features, the closed loop of the loofah is configured around one of the capture features,
and wherein when the closed loop of the loofah is configured around one of the capture features, then tensioning member is rotated towards the handle to rest in the groove and to secure the loofah onto the handle.

2. The washing device of claim 1, wherein the loofah is a string loofah.

3. The washing device of claim 1, wherein the sponge portion is a sponge material.

4. The washing device of claim 1, wherein the capture features are each tooth-shaped.

5. The washing device of claim 1, wherein the handle further comprises a handle length.

6. The washing device of claim 5, wherein the handle length is at least 12 inches.

7. The washing device of claim 5, wherein the handle length is at least 16 inches.

8. The washing device of claim 1, wherein the washing end comprises a washing end diameter.

9. The washing device of claim 8, wherein the washing end diameter is at least 3 inches and not more than 6 inches.

10. A method of washing oneself, comprising:
providing a handle, the handle comprising:
a washing end;
a handle end;
a top surface, the top surface comprising a groove;
a tensioning member, the tensioning member comprising a plurality of capture features, wherein the tensioning member of the handle is rotatably attached to the handle, and wherein when the tensioning member is rotated towards the handle, the tensioning member rests within the groove of the top surface of the handle, and wherein when the tensioning member is rotated away from the handle, the plurality of capture features is revealed;
providing a loofah, the loofah comprising:
a sponge portion;
a rope, the rope comprising a first end and a second end, wherein the first end and the second end of the rope are permanently affixed to the sponge portion of the loofah to create a closed loop;
configuring the sponge portion of the loofah against the washing end of the handle;
rotating the tensioning member away from the handle;
configuring the closed loop around one of the capture features;
rotating the tensioning member towards the handle such that the tensioning member rests within the groove of the top surface of the handle;
grasping the handle portion of the handle; and
using the loofah configured on the washing end of the handle to wash oneself.

11. The method of claim 10, further comprising adding a soap to the loofah before using the loofah to wash oneself.

12. The method of claim 10, wherein the loofah is a string loofah.

13. The method of claim 10, wherein the sponge portion is a sponge material.

14. The method of claim 10, wherein the capture features are each tooth-shaped.

15. The method of claim 10, wherein the handle further comprises a handle length.

16. The method of claim 15, wherein the handle length is at least 12 inches.

17. The method of claim 16, wherein the handle length is at least 16 inches.

18. The method of claim 10, wherein the washing end comprises a washing end diameter.

19. The method of claim 18, wherein the washing end diameter is at least 3 inches and not more than 6 inches.

* * * * *